US005503762A

United States Patent [19]

Bongardt et al.

[11] Patent Number: 5,503,762

[45] Date of Patent: Apr. 2, 1996

[54] BASE OILS WITH A HIGH VISCOSITY INDEX AND IMPROVED LOW-TEMPERATURE BEHAVIOR

[75] Inventors: Frank Bongardt, Duesseldorf; Nicole Windges, Langenfeld, both of Germany

[73] Assignee: Henkel Kommanditgesellschaft auf Aktien, Duesseldorf, Germany

[21] Appl. No.: 367,197

[22] PCT Filed: Jun. 30, 1993

[86] PCT No.: PCT/EP93/01686

§ 371 Date: Jan. 9, 1995

§ 102(e) Date: Jan. 9, 1995

[87] PCT Pub. No.: WO94/01516

PCT Pub. Date: Jan. 20, 1994

[30] Foreign Application Priority Data

Jul. 8, 1992 [DE] Germany ..... 42 22 341.5

[51] Int. Cl.[6] ..... C10M 105/42; C10M 105/44

[52] U.S. Cl. ..... 252/56 S

[58] Field of Search ..... 252/56 S

[56] References Cited

U.S. PATENT DOCUMENTS

| | | | |
|---|---|---|---|
| 2,499,983 | 3/1950 | Beavers | 252/56 S |
| 2,588,194 | 3/1952 | Arundale et al. | 252/56 S |
| 2,937,996 | 5/1960 | Pethrick et al. | 252/56 S |
| 2,944,973 | 7/1960 | Langer et al. | 252/56 S |
| 3,000,917 | 9/1961 | Babayan | 260/404.8 |
| 3,016,353 | 1/1962 | Matuszak | 252/56 S |
| 3,047,504 | 7/1962 | Peters et al. | 252/56 S |
| 3,048,608 | 8/1962 | Girard et al. | 252/56 S |
| 3,223,636 | 12/1965 | Metro et al. | 252/56 S |
| 3,337,457 | 8/1967 | Fowler et al. | 252/56 S |
| 3,778,454 | 12/1973 | Kleiman et al. | 252/56 S |
| 3,875,069 | 4/1975 | Worschech et al. | 252/56 S |
| 4,036,771 | 7/1977 | Denis et al. | 252/56 S |
| 4,113,642 | 9/1978 | Koch et al. | 252/56 S |
| 4,790,957 | 12/1988 | Mach et al. | 252/56 S |
| 5,096,606 | 3/1992 | Hagihara et al. | 252/56 S |
| 5,185,092 | 2/1993 | Fukuda et al. | 252/56 S |

FOREIGN PATENT DOCUMENTS

| | | |
|---|---|---|
| 1907768 | 6/1971 | Germany . |
| 2312622 | 10/1973 | Germany . |
| 2551173 | 5/1977 | Germany . |
| 1420824 | 1/1976 | United Kingdom . |
| 1460665 | 1/1977 | United Kingdom . |

*Primary Examiner*—Jerry D. Johnson
*Attorney, Agent, or Firm*—Ernest G. Szoke; Wayne C. Jaeschke; Daniel S. Ortiz

[57] ABSTRACT

A base oil with a high viscosity index and low pour point which is a mixture of a complex ester formed from aliphatic, cycloaliphatic or aromatic dicarboxylic acids, aliphatic polyols containing 2 to 6 hydroxyl groups and aliphatic monocarboxylic acids containing 6 to 22 carbon atoms and adipic acid esters of unbranched aliphatic monohydric alcohols.

19 Claims, No Drawings

BASE OILS WITH A HIGH VISCOSITY INDEX AND IMPROVED LOW-TEMPERATURE BEHAVIOR

FIELD OF THE INVENTION

This invention relates to base oils with a high viscosity index and improved low-temperature behavior which contain complex esters and adipic acid esters of unbranched monohydric alcohols, to a process for the production of these base oils and to their use as hydraulic, compressor and motor oils.

BACKGROUND OF THE INVENTION

It has long been known that synthetic esters can be used both as a base oil and as an additive in lubricants. By comparison with the less expensive, but environmentally less safe mineral oils, synthetic esters were mostly used as base oils in cases where the viscosity/temperature behavior was expected to meet stringent demands and a low pour point was required, as in aircraft turbine oils. Recently, esters based on oleochemicals have been acquiring increasing significance because they combine high performance levels with biodegradability. Esters based on oleochemicals are generally divided into 5 groups, namely: monoesters, glycerol esters, dicarboxylic acid esters, polyol esters and complex esters. For technological and economic reasons, the dicarboxylic acid esters are derived above all from adipic acid, trimethyl adipic acid, sebacic acid, azelaic acid, dodecanedioic acid and brassylic acid, $C_{6-12}$ dicarboxylic acid derivatives in particular acquiring increasing significance because they show very good viscosity/temperature behavior. In the field of lubricating oils, the viscosity/temperature ratio is generally characterized by the socalled viscosity index (VI) which is determined at 40° and 100° C. in accordance with DIN 51562 and calculated in accordance with DIN ISO 2909. High VI values indicate that minor variations in viscosity are observed at various temperatures. Most of the dicarboxylic acid esters mentioned above have high VI values. Thus, linear dicarboxylic acid esters of adipic acid in particular, with VI values of 200 and higher, show very little dependence of viscosity on temperature. However, the disadvantage of the above-mentioned dicarboxylic acid esters of adipic acid is their low viscosity so that they are not suitable for all fields of application.

Complex esters made up of polybasic carboxylic acids and polyols and monocarboxylic acids show higher viscosities than adipic acid esters. Unfortunately, however, these complex esters do not exhibit such good viscosity/temperature behavior and, hence, have lower VI values than the dicarboxylic acid esters of adipic acid.

Although both the adipic acid esters and the complex esters show acceptable low-temperature behavior insofar as the pour point, i.e. the temperature obtained by adding 3° C. to the temperature read off, at which the sample no longer flows after cooling, is of the order of −30° C., it is of advantage for certain applications for the base oil to have an even lower pour point.

The problem addressed by the present invention was to provide base oils which would show improved low temperature behavior (pour point) and which, in addition, would have higher viscosities than the known adipic acid esters. In addition, these base oils would exhibit very good viscosity/temperature behavior and would have VI values above 200.

SUMMARY OF THE INVENTION

Surprisingly, base oils of certain complex esters and the dicarboxylic acid esters of adipic acid show better low-temperature behavior coupled with a high viscosity index.

The present invention relates to base oils containing

I. complex esters of
   aliphatic, cycloaliphatic and/or aromatic dicarboxylic acids containing 2 to 36 carbon atoms,
   b) aliphatic polyols containing 2 to 6 hydroxyl groups,
   c) aliphatic monocarboxylic acids containing 6 to 22 carbon atoms and II. adipic acid esters of unbranched aliphatic monohydric alcohols.

The base oils according to the invention are products liquid at room temperature (20° to 25° C.). The complex esters and adipic acid esters present in the base oils according to the invention are so-called full esters, in other words these esters should not contain any free hydroxyl groups or even carboxyl groups per molecule. Instead, the complex esters and adipic acid esters should have no hydroxyl or acid values or—because esterification is never complete in practice—only low hydroxyl or acid values, preferably below 3.

DETAILED DESCRIPTION OF THE INVENTION

The adipic acid esters present in the base oils according to the invention are compounds known per se which are formed by esterification of adipic acid with unbranched aliphatic monohydric alcohols. Adipic acid esters derived from saturated alcohols are preferred. Since the adipic acid esters should be liquid, those derived from saturated alcohols containing 1 to 4 carbon atoms, more particularly from methanol, ethanol, propanol and/or butanol, are most particularly preferred. Within this group, dibutyl adipate is particularly important, especially since it also has an excellent VI.

The complex esters present in the base oils according to the invention are also compounds known per se. Thus, DE-C-19 07 768, for example, describes the use of such complex esters as lubricants for thermoplastics. These complex esters may also readily be prepared by esterification of the dicarboxylic acids, polyols and monocarboxylic acids. Suitable aliphatic, cycloaliphatic or aromatic dicarboxylic acids are oxalic acid, malonic acid, succinic acid, glutaric acid, adipic acid, pimelic acid, suberic acid, azelaic acid, sebacic acid, undecanedicarboxylic acid, eicosanedicarboxylic acid, maleic acid, fumaric acid, citraconic acid, mesaconic acid, itaconic acid, cyclopropane, cyclobutane and cyclopentanedicarboxylic acid, camphoric acid, hexahydrophthalic acid, phthalic acid, terephthalic acid, isophthalic acid, naphthalic acid, diphenyl-o,o'-dicarboxylic acid and dimer fatty acids. Dimer fatty acids in the context of the invention are dicarboxylic acids which are prepared by dimerization of mono- or polyunsaturated monocarboxylic acids in the presence of catalysts. Preferred dimer fatty acids are those which have been prepared by dimerization of monounsaturated $C_{12-22}$ monocarboxylic acids and, in particular, those which have been prepared by dimerization of oleic acid. Of the aliphatic dicarboxylic acids, those containing 6 to 10 carbon atoms are particularly preferred, the saturated representatives thereof being most particularly preferred. Within the group of aromatic dicarboxylic acids, phthalic acid is particularly suitable. Instead of the dicarboxylic acids, their anhydrides may also be used to prepare the complex esters. Overall, aliphatic dicarboxylic acids containing 6 to 10 carbon atoms, phthalic acid and/or dimer fatty acid are preferred dicarboxylic acids for the complex esters, the dimer fatty acid having been prepared by dimerization of monounsaturated $C_{12-22}$ monocarboxylic acids.

Suitable aliphatic polyols on which the complex esters are based are, for example, ethylene glycol, 1,2-propylene glycol, 1,3-propylene glycol, butane-1,4-diol, butane-2,3-diol, pentane-1,5-diol, hexane-1,6-diol, glycerol, trimethylol propane, erythritol, pentaerythritol, dipentaerythritol, xylitol, mannitol and/or sorbitol. Particularly preferred representatives of these polyols are branched polyols which preferably contain tertiary carbon atoms (i.e. those with no hydrogen atom) adjacent the primary hydroxyl groups, such as trimethylol propane, pentaerythritol, neopentyl glycol, dipentaerythritol and/or mixtures thereof.

Examples of aliphatic $C_{6-22}$ monocarboxylic acids from which the complex esters are synthesized include caprylic acid, pelargonic acid, capric acid, undecanoic acid, lauric acid, lauroleic acid, tridecanoic acid, myristic acid, myristoleic acid, pentadecanoic acid, palmitic acid, palmitoleic acid, heptadecanoic acid, stearic acid, petroselic acid, petroselaidic acid, oleic acid, elaidic acid, linoleic acid, linolaidic acid, linolenic acid, nonadecanoic acid, arachic acid, arachidonic acid, behenic acid, erucic acid and/or brassidic acid. Among this group of saturated and/or unsaturated monocarboxylic acids, the linear representatives are preferred.

The complex esters present in the base oils according to the invention are preferably synthesized in such a way that, on a statistical average, 25 to 75% of the 2 to 6 hydroxyl groups of the polyols are esterified with dicarboxylic acids and 75 to 25% with monocarboxylic acids. Calculation of the percentage of esterified hydroxyl groups is formally based on the number of hydroxyl groups present in the reaction mixture forming the complex esters and on the fact that 25 or 75% of this reaction mixture is esterified with dicarboxylic acids or monocarboxylic acids. Accordingly, so far as the complex esters formed are concerned, it is completely immaterial on a statistical average whether the dicarboxylic acid esterifies 2 carboxyl groups of one polyol or—in a bridge-like arrangement—2 hydroxyl groups of two polyols.

The base oils according to the invention preferably contain the complex esters in quantities of 25 to 75% by weight and the adipic acid esters in quantities of 75 to 25% by weight, based on the base oil.

Particularly preferred base oils contain dibutyl adipate in quantities of 25 to 75% by weight and complex esters of a) dimer fatty acids, adipic acid, pimelic acid, suberic acid, azelaic acid, sebacic acid and/or phthalic acid and b) neopentyl glycol, trimethylol propane, pentaerythritol, dipentaerythritol and/or mixtures thereof and c) caprylic acid, capric acid, lauric acid, myristic acid, palmitic acid, stearic acid and/or oleic acid in quantities of 25 to 75% by weight.

The base oils according to the invention have a pour point which is distinctly lower than the pour points of the individual complex esters and adipic acid esters. By virtue of their distinctly lower pour point, therefore, the low-temperature behavior of the base oils according to the invention is very much better because it is only at a relatively low temperature that the base oils lose their ability to flow. Accordingly, the base oils according to the invention open up fields of application which have hitherto been closed to the individual complex esters and adipic acid esters. In addition, the base oils according to the invention show a distinctly higher viscosity than the pure adipic acid esters, so that they are suitable for a broader range of applications than the low-viscosity adipic acid esters. In addition, the base oils according to the invention show better viscosity/temperature temperature behavior than the pure complex esters, so that their range of applications is broader in this regard, too. The fact that the complex esters and the adipic acid esters can be mixed with one another in broad quantity ratios and still always show the improved low-temperature behavior (pour point) is another particularly favorable aspect of the base oils according to the invention. The base oil can thus be adjusted to any viscosity using the different viscosities of the complex esters and the adipic acid ester. Thus, it is possible through larger additions of the low-viscosity adipic acid ester to obtain an, overall, relatively low-viscosity base oil which, in addition, has an extremely high viscosity index.

The present invention also relates to a process for the production of base oils with a high viscosity index and improved low temperature behavior, characterized in that complex esters of a) aliphatic, cycloaliphatic and/or aromatic dicarboxylic acids containing 2 to 36 carbon atoms, b) aliphatic polyols containing 2 to 6 hydroxyl groups, c) aliphatic monocarboxylic acids containing 6 to 22 carbon atoms are mixed with adipic acid esters of unbranched, aliphatic monohydric alcohols.

If desired, the base oils according to the invention may additionally contain monoesters, glycerol esters and/or polyol esters or even mineral oils. The quantity of these additional esters or mineral oils is determined by the particular application envisaged. In addition, the base oils according to the invention may contain additives for further optimization to their particular application. Suitable additives are, for example, oxidation inhibitors, such as sulfur, phosphorus, phenol derivatives or even amines; detergents, such as naphthenates, stearates, sulfonates, phenolates, phosphates, phosphonates or methacrylate copolymers; extreme pressure additives, such as sulfur and chlorine compounds; foam inhibitors; demulsifiers; corrosion inhibitors and even friction coefficient reducers. If desired, known viscosity index improvers, such as polyalkyl styrenes, polyolefins, polymethacrylates, polyisobutenes and diene polymers, may also be added to the base oils according to the invention, although this does make them more sensitive to shearing. On the whole, the base oils according to the invention show such favorable viscosity/temperature behavior that there is no need to add viscosity index improvers. Thus, another advantage of the base oils according to the invention is that they are not as sensitive to shearing as mineral oils to which viscosity index improvers have to be added.

The base oils according to the invention may be used for a broad range of applications. By virtue of their quality profile, however, they are particularly preferred as hydraulic, compressor and motor oils.

Examples

A) Preparation of the complex esters

1) Complex ester of trimethylol propane, oleic acid, dimer fatty acid 171.84 g of trimethylol propane, corresponding to 1.42 moles, 685.2 g of technical oleic acid (composition in % by weight: $C_{16'}$, 5; $C_{17}$ 1; $C_{18}$ 2; $C_{18'}$67; $C_{18''}$12; $C_{18'''}$ 1; $>C_{18}$ 2; acid value AV according to DIN 53402=198), corresponding to 2.4 moles, and 327.77 g of $C_{18}$ dimer fatty acid with an AV of 193, corresponding to 1.1 moles, were esterified with one another at a temperature increasing to 240° C. in the presence of 0.33 g of tin oxalate. The esterification was terminated when the acid value of the complex ester obtained was below 1. The complex ester was bleached with bleaching clay at 90° C. and then filtered off.

Characteristic data:

Saponification value SV (according to DIN 53401) 185

Iodine value IV (according to DGF-C-V 11b) 85

VI (according to DIN 51562 and calculated in accordance with DIN ISO 2909) 186

Pour point (according to DIN ISO 3016) −31° C.

2) Complex ester of trimethylol propane, oleic acid and dimer fatty acid 159.05 g of trimethylol propane, corresponding to 1.325 moles, 570 g of technical oleic acid (acid value 198), corresponding to 2 moles, and 411.0 g of $C_{18}$ dimer fatty acid (acid value 183), corresponding to 1.3 moles, were reacted and worked up as in Example 1. A complex ester having the following characteristic data was obtained:

SV=180; IV=85; VI=200; pour point=−32° C.

3) Complex ester of dipentaerythritol, isononanoic acid, $C_{8/10}$ fatty acid and phthalic acid 320.25 g of dipentaerythritol, corresponding to 1.26 moles, 172.5 g of isononanoic acid, corresponding to 1.1 moles, 646.5 g of $C_{8/10}$ fatty acid (composition in % by weight: 69–75 $C_8$; 23–27 $C_{10}$; rest $C_6$ and $C_{12}$; acid value 368), corresponding to 4.2 moles, and 121.75 g of phthalic anhydride, corresponding to 0.8 mole, were reacted and worked up as in Example 1. The complex ester obtained had the following characteristic data: SV=360; IV=<1, VI=100; pour point=−15° C.

B.) Production of the base oils

Complex esters A1) to A3) were mixed with various quantities of dibutyl adipate (VI=>250; pour point=−31° C.). The mixing ratios, $V_{40}$ and the pour point of the base oils are shown in Table I. The quantities of esters are shown in parts by weight (P).

TABLE I

Base oils and characteristic data

| | Base oil | | | Pour point | |
|---|---|---|---|---|---|
| | Complex ester | DBA* | $V_{40}$ in mm²/s | in °C. | VI |
| I | 61 P Ex. A 1) | 39 P | 46.58 | −51 | 255 |
| II | 50 P Ex. A 1) | 50 P | 28.68 | −51 | 243 |
| III | 25 P Ex. A 1) | 75 P | 10.68 | −51 | 219 |
| IV | 29 P Ex. A 2) | 71 P | 19.51 | −51 | 282 |
| V | 43 P Ex. A 3) | 57 P | 18.00 | −51 | 215 |
| Comp. I | 100 P Ex. A 1) | 0 P | 320 | −31 | 186 |
| Comp. II | 100 P Ex. A 2) | 0 P | 980–1080 | −32 | 200 |
| Comp. III | 100 P Ex. A 3) | 0 P | 840 | −15 | 100 |
| Comp. IV | 0 | 100 P | 3.6 | −31 | >250 |

*DBA = dibutyl adipate

It can be seen from Table I that base oils containing the low-viscosity dibutyl adipate and the high-viscosity complex esters on the one hand have a higher viscosity than pure dibutyl adipate and, on the other hand, have very much lower pour points than the pure starting materials.

We claim:

1. A base oil comprising:

I. complex esters formed from a) at least one dicarboxylic acid selected from the group consisting of aliphatic dicarboxylic acids, cycloaliphatic dicarboxylic acids and aromatic dicarboxylic acids each containing from 2 to 44 carbon atoms, b) at least one aliphatic polyol containing 2 to 6 hydroxyl groups, and c) at least one aliphatic monocarboxylic acid containing 6 to 22 carbon atoms; and II. adipic acid esters of unbranched aliphatic monohydric alcohols containing 1 to 4 carbon atoms.

2. The base oil as claimed in claim 1, containing adipic acid esters of saturated alcohols.

3. The base oil as claimed in claim 1, comprising complex esters in which 25 to 75% of the hydroxyl groups of the polyols are esterified with the dicarboxylic acids and 75 to 25% of the hydroxyl groups of the polyols are esterified with the monocarboxylic acids.

4. The base oil as claimed in claim 1, comprising complex esters of at least one dicarboxylic acid selected from the group consisting of aliphatic dicarboxylic acids containing 6 to 10 carbon atoms, phthalic acid and dimer fatty acid, the dimer fatty acid obtained by dimerization of monounsaturated $C_{12-22}$ monocarboxylic acids.

5. The base oil as claimed in claim 1, comprising complex esters of branched polyols.

6. The base oil as claimed in claim 1, comprising complex esters of linear monocarboxylic acids.

7. The base oil as claimed in claim 1, comprising 25 to 75% by weight of the complex esters and 75 to 25% by weight of the adipic acid esters.

8. A process for the production of base oils with a high viscosity index and improved low-temperature properties which comprises: mixing complex esters formed from at least one dicarboxylic acid selected from the group consisting of a) aliphatic dicarboxylic acids, cycloaliphatic dicarboxylic acids and aromatic dicarboxylic acids each containing from 2 to 44 carbon atoms, b) at least one aliphatic polyol containing 2 to 6 hydroxyl groups, c) at least one aliphatic monocarboxylic acid containing 6 to 22 carbon atoms with adipic acid esters of unbranched, aliphatic monohydric alcohols containing 1 to 4 carbon atoms.

9. A hydraulic oil comprising the base oil of claim 1 and one or more lubricant additives.

10. A compressor oil comprising the base oil of claim 1 and one or more lubricant additives.

11. A motor oil comprising the base oil of claim 1 and one or more lubricant additives.

12. The base oil of claim 1 wherein the complex esters are formed with aliphatic polyols comprising polyols containing tertiary carbon atoms adjacent a carbon atom with a primary hydroxyl group.

13. The base oil of claim 12 wherein the polyols comprise at least one polyol selected from the group consisting of neopentyl glycol, trimethylol propane, pentaerythritol and dipentaerythritol.

14. The base oil of claim 1 wherein the dicarboxylic acid a) comprises at least one dicarboxylic acid or anhydride thereof selected from the group consisting of oxalic acid, malonic acid, succinic acid, glutaric acid, adipic acid, pimelic acid, suberic acid, azelaic acid, sebacic acid, undecanedicarboxylic acid, eicosanedicarboxylic acid, maleic acid, fumaric acid, citraconic acid, mesaconic acid, itaconic acid, cyclopropane, cyclobutane and cyclopentanedicarboxylic acid, camphoric acid, hexahydrophthalic acid, phthalic acid, terephthalic acid, isophthalic acid, naphthalic acid, diphenyl-o,o'-dicarboxylic acid and dimer fatty acids.

15. The base oil of claim 14 wherein the dicarboxylic acid a) comprises at least one dicarboxylic acid or anhydride thereof selected from the group consisting of aliphatic dicarboxylic acids containing 6 to 10 carbon atoms, phthalic acid and dimer fatty acids prepared by dimerization of monounsaturated monocarboxylic acids containing from 12 to 22 carbon atoms.

16. The base oil of claim 14 wherein the polyol b) comprises at least one polyol selected from the group consisting of ethylene glycol, 1,2-propylene glycol, 1,3-propylene glycol, butane-1,4-diol, butane-2,3-diol, pentane-1,5-diol, hexane-1,6-diol, glycerol, neopentyl glycol, trimethylol propane, erythritol, pentaerythritol, dipentaerythritol, xylitol, mannitol, and sorbitol.

17. The base oil of claim 16 wherein the monocarboxylic acid c) comprises at least one monocarboxylic acid selected from the group consisting of caprylic acid, pelargonic acid, capric acid, undecanoic acid, lauric acid, lauroleic acid, tridecanoic acid, myristic acid, myristoleic acid, pentadecanoic acid, palmitic acid, palmitoleic acid, heptadecanoic acid, stearic acid, petroselic acid, petroselaidic acid, oleic acid, elaidic acid, linoleic acid, linolaidic acid, linolenic acid, nonadecanoic acid, arachic acid, arachidonic acid, behenic acid, erucic acid and brassidic acid.

18. The base oil of claim 1 wherein the polyol b) comprises at least one polyol selected from the group consisting of ethylene glycol, 1,2-propylene glycol, 1,3-propylene glycol, butane-1,4-diol, butane-2,3-diol, pentane-1,5-diol, hexane-1,6-diol, glycerol, neopentyl glycol, trimethylol propane, erythritol, pentaerythritol, dipentaerythritol, xylitol, mannitol, and sorbitol.

19. The base oil of claim 1 wherein the monocarboxylic acid c) comprises at least one monocarboxylic acid selected from the group consisting of caprylic acid, pelargonic acid, capric acid, undecanoic acid, lauric acid, lauroleic acid, tridecanoic acid, myristic acid, myristoleic acid, pentadecanoic acid, palmitic acid, palmitoleic acid, heptadecanoic acid, stearic acid, petroselic acid, petroselaidic acid, oleic acid, elaidic acid, linoleic acid, linolaidic acid, linolenic acid, nonadecanoic acid, arachic acid, arachidonic acid, behenic acid, erucic acid and brassidic acid.

* * * * *